US010018947B2

(12) United States Patent
Song et al.

(10) Patent No.: US 10,018,947 B2
(45) Date of Patent: Jul. 10, 2018

(54) IMAGE FORMING APPARATUS AND FUSER DRIVING CONTROL METHOD

(71) Applicant: S-Printing Solution Co., Ltd., Suwon-si, Gyeonggi-do (KR)

(72) Inventors: Jeong-chul Song, Gwangmyeong-si (KR); Sang-cheol Moon, Suwon-si (KR); Hwan-hee Kim, Hwaseong-si (KR); Kwang-sun Song, Seoul (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/323,864

(22) PCT Filed: Dec. 23, 2014

(86) PCT No.: PCT/KR2014/012685
§ 371 (c)(1),
(2) Date: Jan. 4, 2017

(87) PCT Pub. No.: WO2016/010209
PCT Pub. Date: Jan. 21, 2016

(65) Prior Publication Data

US 2017/0146937 A1 May 25, 2017

(30) Foreign Application Priority Data

Jul. 14, 2014 (KR) ..... 10-2014-0088618

(51) Int. Cl.
*G03G 15/20* (2006.01)

(52) U.S. Cl.
CPC ..... *G03G 15/2078* (2013.01); *G03G 15/2042* (2013.01)

(58) Field of Classification Search
CPC ..... G03G 15/2039; G03G 15/2042; G03G 15/2078; G03G 15/2082
See application file for complete search history.

(56) References Cited

U.S. PATENT DOCUMENTS 6,965,741 B2 11/2005 Senda
7,088,934 B2 8/2006 Lee
(Continued)

FOREIGN PATENT DOCUMENTS

JP 2001-282032 10/2001
JP 2003-43852 2/2003
(Continued)

OTHER PUBLICATIONS

International Search Report dated Mar. 31, 2015 in corresponding International Application No. PCT/KR2014/012685.

*Primary Examiner* — Erika J Villaluna
(74) *Attorney, Agent, or Firm* — Staas & Halsey LLP

(57) ABSTRACT

An image forming apparatus as provided includes: a heating roller heated using a first heater unit disposed in the center thereof and second heater units disposed on both sides of the first heater unit; a pressure roller in pressing contact with the heating roller to form a nip; first and second sensors for detecting the temperature of a central area of the heating roller the temperature of a side area of the heating roller, respectively; and a controller for individually controlling the first and second heater units according to the respective temperatures measured by the first and second sensors when the temperature measured by the second sensor is lower than a predetermined first temperature, and commonly controlling the first and second heater units according to the temperature measured by the first sensor when the temperature measured by the second sensor is equal to or higher than the predetermined first temperature.

15 Claims, 21 Drawing Sheets

(56) References Cited

U.S. PATENT DOCUMENTS

| | | | | |
|---|---|---|---|---|
| 2003/0185583 | A1* | 10/2003 | Senda | G03G 15/2014 399/69 |
| 2007/0297826 | A1 | 12/2007 | Tateishi et al. | |
| 2011/0305476 | A1 | 12/2011 | Kitami | |
| 2012/0051766 | A1* | 3/2012 | Ueno | G03G 15/205 399/45 |
| 2013/0302055 | A1 | 11/2013 | Soda et al. | |

FOREIGN PATENT DOCUMENTS

| | | |
|---|---|---|
| JP | 2003-156964 | 5/2003 |
| JP | 2003-280444 | 10/2003 |
| JP | 2003-287976 | 10/2003 |
| JP | 2004-85601 | 3/2004 |
| JP | 2004-264397 | 9/2004 |
| JP | 2004-361535 | 12/2004 |
| JP | 2006-11209 | 1/2006 |
| KR | 10-2005-0006989 | 1/2005 |
| KR | 10-2013-0110585 | 10/2013 |

* cited by examiner

FIG. 11

| TEST CONDITION | TGC | TGS(=TSL) | DUTY CONDITION |
|---|---|---|---|
| EXISTING CONTROL 1 | 175℃ | 135℃ | APPLY SAME DUTY TABLE |
| EXISTING CONTROL 2 | 175℃ | 125℃ | |
| NEW CONTROL | 175℃ | 125℃ | |

IMAGE FORMING APPARATUS AND FUSER DRIVING CONTROL METHOD

CROSS-REFERENCE TO RELATED APPLICATIONS

This application is a U.S. national stage application, which claims the benefit under 35 USC § 371 of PCT International Patent Application No. PCT/KR2014/012685 filed Dec. 23, 2014 which claims foreign priority benefit under 35 USC § 119 of Korean Patent Application No. 10-2014-0088618, filed on Jul. 14, 2014 in the Korean Intellectual Property Office, the entire contents of which are incorporated herein by reference.

BACKGROUND OF THE INVENTION

Field of the Invention

Apparatuses and methods consistent with the present disclosure relate to an image forming apparatus and a fuser driving control method, and more particularly, to an image forming apparatus and a fuser driving control method capable of controlling a plurality of heater units by different schemes according to a temperature range of a heating roller.

Description of the Related Art

An image forming apparatus means an apparatus that prints printing data generated from a printing control terminal apparatus like a computer on printing paper. An example of the image forming apparatus may include a copier, a printer, a facsimile, a multi function peripheral (MFP) in which functions of them are compositely implemented in one apparatus, etc.

The image forming apparatus may form an image by various schemes. As one of them, an electro photography scheme is used. In the image forming apparatuses such as a copier and a printer to which the electro photography scheme is applied, photoconductors having a drum form are simultaneously charged, the photoconductors are exposed to light controlled depending on image information, an electrostatic latent image is formed on the photoconductor, a visible image (toner image) is formed by selective adsorption with the electrostatic latent image of the toner, the toner image is transferred to recording paper, and a recording medium on which the transfer is performed passes through a fuser to fuse the toner image on the recording medium, thereby forming the image.

The image forming apparatus may adopt a configuration of finally fusing an image on printing paper. The configuration is called the fuser. Generally, the fuser is configured to include a heating roller having a heater and a pressure roller in pressing contact with the heating roller to be rotatably driven.

The fuser needs to be maintained at appropriate temperature and pressure. In this case, if a temperature of a nip part is too low, a toner layer does not reach a temperature range of glass transition and thus a cold offset to hinder the toner layer from being fused to the recording medium occurs and the non-fused toner may contaminate peripheral parts to damage printed images and parts. In contrast, if the temperature of the nip part is too high, release property between a roller and a toner is greatly reduced and thus a hot offset to stick some of the toner to the roller occurs.

Further, after a nip is notified, a curl occurs in paper. The curl amount is increased as the temperature is generally increased. Therefore, the high temperature increases the curl amount of paper to increase a jam occurrence frequency. Further, when the high temperature is maintained for a long time, a lifespan of the fuser may be reduced and energy may be excessively consumed. Therefore, a heat quantity control of the heater to maintain a temperature of the fuser at an appropriate level is one of the important areas of the development of the image fuser in terms of the improvement in quality of the printed image, the lifespan of the fuser, and the energy efficiency.

Meanwhile, the heater positioned in the heating roller is configured in plural to adaptively provide heat to paper having various widths. In detail, a dual type heater in which a heat distribution of one heater is concentrated on a central portion and a heat distribution of the other heater is concentrated on both end portions has been widely used. Therefore, a temperature sensor of the fuser is configured in plural to measure the temperature of the central portion of the heating roller and the temperature of both end portions thereof, respectively.

As the existing temperature sensor, a contacting sensor operated by contacting the heating roller is used. In this case, image deterioration like a printing gloss deviation due to a difference in temperature between a portion that the temperature sensor contacts and a portion that the temperature sensor does not contact may occur. To improve the image deterioration, a non-contacting sensor is used, which incurs an increase in material costs.

Meanwhile, the sensor positioned at the central portion of the heating roller is positioned in a notification area through which the printing paper passes, and therefore the use of a non-contacting sensor may not be avoided to prevent the image deterioration due to the sensor contact. However, a side sensor positioned at the end portion may be positioned in the notification area or the non-notification area. When the side sensor is positioned in the non-notification area, the effect due to the sensor contact is not generated in the printed image, and therefore the contacting sensor may be used.

However, the contacting sensor is positioned in the non-notification area, and therefore it is difficult to accurately control the heaters of both end portions to the wanted temperature. Therefore, even when the contacting sensor and the non-contacting sensor are used together, a method for appropriately controlling temperature is required.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present disclosure provides an image forming apparatus and a fuser driving control method capable of controlling a plurality of heater units by different schemes according to a temperature range of a heating roller.

According to an aspect of the present disclosure, an image forming apparatus includes: a heating roller heated using a first heater unit placed in a center thereof and second heater units placed on both sides of the first heater unit; a pressure roller in pressing contact with the heating roller to form a nip; a first sensor detecting a temperature of a central area of the heating roller; a second sensor detecting the temperature of a side area of the heating roller; and a controller individually controlling the first heater unit and the second heater units according to the respective temperatures measured by the first sensor and the second sensor when the temperature measured by the second sensor is lower than a predetermined first temperature and commonly controlling the first heater unit and the second heater units according to the temperature measured by the first sensor when the temperature measured by the second sensor is equal to or higher than the predetermined first temperature.

The controller may set a first heating value based on a temperature difference between the temperature of the first sensor and the central target temperature to control the first heater unit and set a second heating value based on a temperature difference between the temperature of the second sensor and the side target temperature to control the second heater unit when the temperature measured by the second sensor is less than the predetermined first temperature and may set a third heating value based on the temperature difference between the temperature of the first sensor and the central target temperature to commonly control the first heater unit and the second heater unit when the temperature measured by the second sensor is equal to or higher than the predetermined first temperature.

The controller may adjust the central target temperature and the side target temperature based on the temperature measured by the second sensor when the temperature measured by the second sensor is equal to or higher than the predetermined first temperature.

The controller may control the first heater unit according to the temperature measured by the first sensor and turn off a supply of power to the second heater unit when the temperature measured by the second sensor is equal to or higher than a predetermined second temperature higher than the first temperature.

The controller may determine that a fuser overheats and turn off the supply of power to the first heater unit and the second heater unit when the temperature measured by the second sensor is equal to or higher than a predetermined third temperature higher than the second temperature.

The first sensor may be disposed in the central notification area of the heating roller and the second sensor may be disposed in the non-notification area of the heating roller.

The first sensor may be a non-contacting temperature sensor disposed to be spaced apart from the heating roller and the second sensor may be a contacting temperature sensor disposed to contact the heating roller.

The controller may estimate a surface temperature of the pressure roller based on the temperature measured by the second sensor and adjust target temperatures of the first heater unit and the second heater unit based on the estimated surface temperature.

The controller may use a look-up table having a plurality of surface temperature ranges and the target temperatures of the first heater unit and the second heater unit by the plurality of surface temperature ranges to control the first heater unit and the second heater unit.

The controller may determine whether the second heater unit is operated depending on a size of printing paper.

According to another aspect of the present disclosure, a fuser driving control method of an image forming apparatus includes: detecting temperatures of a plurality of areas of a heating roller using a first sensor detecting a temperature of a central area of the heating roller and a second sensor detecting a temperature of a side area of the heating roller; individually controlling the first heater unit and the second heater unit according to the respective temperatures measured by the first sensor and the second sensor when the temperature measured by the second sensor is less than a predetermined first temperature; and commonly controlling the first heater unit and the second heater unit according to the temperature measured by the first sensor when the temperature measured by the second sensor is equal to or higher than the predetermined first temperature.

In the individually controlling, a first heating value may be set based on a temperature difference between a temperature measured by the first sensor and a central target temperature to control the first heater unit and a second heating value may be set based on a temperature difference between a temperature measured by the second sensor and a side target temperature to control the second heater unit and in the commonly controlling, a third heating value may be set based on a temperature difference between the temperature measured by the first sensor and the central target temperature to commonly control the first heater unit and the second heater unit.

In the commonly controlling, the central target temperature and the side target temperature may be adjusted based on the temperature measured by the second sensor.

The fuser driving control method may further include: controlling the first heater unit according to the temperature measured by the first sensor and controlling a supply of power to the second heater unit to be turned off when the temperature measured by the second sensor is equal to or higher than a predetermined second temperature higher than the first temperature.

The fuser driving control method may further include: determining that a fuser overheats and turning off a supply of power to the first heater unit and the second heater unit when the temperature measured by the second sensor is equal to or higher than a predetermined third temperature higher than the second temperature.

BRIEF DESCRIPTION OF THE DRAWING FIGURES

The above and/or other aspects of the present invention will be more apparent by describing certain exemplary embodiments of the present invention with reference to the accompanying drawings, in which:

FIGS. 11 to 13 are diagrams for describing an effect of the heat quantity control method according to the first exemplary embodiment of the present disclosure;

DETAILED DESCRIPTION OF THE EXEMPLARY EMBODIMENTS

Hereinafter, one exemplary embodiment of the present disclosure will be described in detail with reference to the accompanying drawings.

Figure 1:
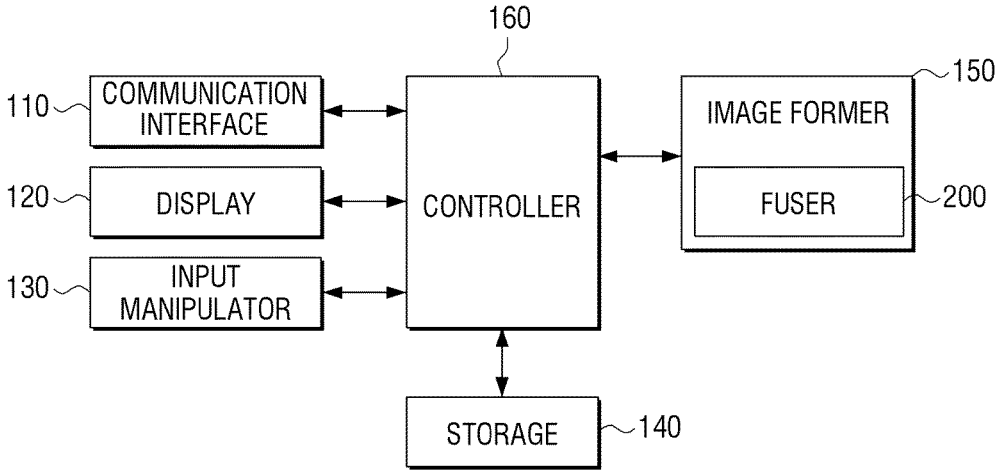
FIG. 1 is a block diagram illustrating a configuration of the image forming apparatus according to an exemplary embodiment of the present disclosure.

FIG. 1 is a block diagram illustrating a configuration of the image forming apparatus according to an exemplary embodiment of the present disclosure.

Referring to FIG. 1, an image forming apparatus 100 according to an exemplary embodiment of the present disclosure is configured to include a communication interface 110, a display 120, a manipulation input 130, a storage 140, an image former 150, and a controller 160.

An example of the image forming apparatus 100 may include a copier, a printer, a scanner, a facsimile, a multi function peripheral (MFP) that functions of them are compositely implemented into one apparatus, or the like.

The communication interface 110 is formed to connect the image forming apparatus 100 to external devices and may be implemented to be connected through a local area network (LAN) and the Internet network and to be connected through a universal serial bus (USB) port and a wireless module. Here, the wireless module may be WiFi, WiFi Direct, near field Communication (NFC), Bluetooth, etc.

Further, the communication interface 110 may receive a job execution command from a host apparatus (not illustrated). Further, the communication interface 110 may transmit and receive data associated with the above-mentioned job execution command. For example, if the job command of a user is printing for a specific file, the communication interface 110 may receive a printing file. Here, the printing file may be data of a printer language such as a postscript (PS) and a printer control language (PCL) and may also be files such as PDF, XPS, BMP, and JPG.

Further, if the job command of the user is a scan command, the communication interface 110 may transmit scan data that is a result of the scan operation to the host apparatus (not illustrated) or another repository (not illustrated).

Further, the communication interface 110 may notify the host apparatus (not illustrated) of a progress state of the requested job command.

The display 120 may display various kinds of information that is supported by the image forming apparatus 100. The display 120 may be a monitor such as an LCD and a CRT and may be implemented in a touch screen which may simultaneously carry out a function of the manipulation input 130 to be described below.

Further, the display 120 may display a screen for controlling a function of the image forming apparatus 100. Further, the display 120 may display an error generated from the image forming apparatus 100. For example, if a fuser overheats, the display 120 may display the occurrence of error.

The manipulation input 130 includes a plurality of function keys by which the user may set or select various kinds of functions supported by the image forming apparatus 100. The manipulation input 130 may be implemented in apparatuses such as a mouse, a keyboard, and the like and may also be implemented in a touch screen which may simultaneously carry out the function of the display 120 described above.

The storage 140 stores a printing file. In detail, the storage 140 may store the printing data received through the communication interface 110. Further, the storage 140 may store a central target temperature and a side target temperature required for fusing or may also store a look-up table that has a plurality of surface temperature ranges and a target temperature of a first heater unit and a target temperature of a second heater unit by the plurality of surface temperature ranges. Meanwhile, the storage 140 may be implemented as a storage medium in the image forming apparatus 100 and an external storage medium, for example, a removable disk including a USB memory, a web server though a network, and the like.

The image former 150 prints printing data. In detail, the image former 150 may perform jobs such as parsing and rendering on the printing data, transfer a toner corresponding to data rendered by an electro photography scheme to printing paper, and fuse and output the printing paper to which the toner is transferred using the fuser 200. The detailed configuration and operation of the fuser 200 will be described below with reference to FIGS. 2 to 5.

The controller 160 controls each component of the image forming apparatus 100. In detail, the controller 160 controls the fuser 200 to have a predetermined temperature when a printing job is requested or an event corresponding to a fusing start is generated.

Further, the controller 160 determines a fusing scheme. Here, the fusing scheme may include a first fusing scheme that uses only the first heater unit to perform the fusing and a second fusing scheme that uses only the first heater unit and the second heater unit to perform the fusing. The first fusing scheme and the second fusing scheme may be determined based on a size of the printing paper that is a fusing object. For example, if the fusing is performed in a wide direction of A4 sheet, the controller 160 may determine that the fusing is performed by the second fusing scheme. In this case, the heat quantity control according to the exemplary embodiment of the present disclosure as described below may be applied.

If the fusing is performed in a narrow direction of A4 sheet, the controller 160 may determine that the fusing is performed by the first fusing scheme. In this case, the heat quantity control may be performed by a scheme of controlling only a first heater unit using only a temperature measured by a first sensor.

Meanwhile, if it is determined that the fusing is performed by the second fusing scheme heating the heating roller using both of the first heater unit and the second heater unit, the controller 160 may use the first sensor detecting a temperature of a central area of the heating roller and a second sensor detecting a temperature of a side area of the heating roller to sense a temperature of a central area and a side area of the heating roller.

Further, the controller may determine a temperature control scheme for the first heater unit and the second heater unit according to the sensed temperature of the second sensor. In detail, if the sensed temperature of the second sensor is less than a predetermined first temperature, the controller 160 may individually control the first heater unit and the second heater unit according to the respective temperatures measured by the first sensor and the second sensor. In more detail, if the temperature measured by the second sensor is less than the predetermined first temperature, the controller 160 may set a first heating value based on a difference between a temperature of the first sensor and a central target temperature to control the first heater unit and may set a second heating value based on a difference between a temperature of the second sensor and a side target temperature to control the second heater unit.

Here, the first temperature is a lower bound of a temperature range in which the side area of the heating roller may normally perform the fusing.

Meanwhile, if the sensed temperature of the second sensor is equal to or higher than the predetermined first temperature, the controller 160 commonly controls the first heater unit and the second heater unit according to the temperature measured by the first sensor. In detail, if the temperature measured by the second sensor is equal to or higher than the predetermined first temperature, the controller 160 may set a third heating value based on a difference between the first temperature and the central target temperature to commonly control the first heater unit and the second heater unit. In other words, the control scheme for the first heater unit may perform the control by the same scheme regardless of the temperature of the second sensor, but the control scheme for the second heater unit may perform different control according to the temperature of the second sensor. The driving scheme of the controller 160 will be described in detail with reference to FIG. 10.

In this case, the controller 160 may estimate a surface temperature of the pressure roller based on the temperature measured by the second sensor and adjust the target temperature of the first heater unit and the second heater unit based on the estimated surface temperature. The driving scheme of the controller 160 will be described below with reference to FIGS. 14 to 17.

Meanwhile, if the sensed temperature of the second sensor is equal to or higher than a predetermined second temperature higher than the first temperature, the controller 160 may control the first heater unit according to the temperature measured by the first sensor and turn off the supply of power to the second heater unit. Here, the second temperature is an upper bound of a temperature range in which the side area of the heating roller may normally perform the fusing and may be the side target temperature.

Further, if the sensed temperature of the second sensor is equal to or higher than a predetermined third temperature higher than the second temperature, the controller 160 may determine that the fuser overheats and turn off the supply of power to the first heater unit and the second heater unit. Here, the predetermined third temperature may be a temperature value that is an addition of a predetermined margin temperature to the predetermined second temperature or a temperature value that is a subtraction of the margin temperature from a temperature at which the fuser may bear. The operation of the controller 160 will be described below with reference to FIG. 18.

As described above, the image forming apparatus 100 according to the exemplary embodiment of the present disclosure individually controls the first heater unit and the second heater unit at the time of an initial driving of the fuser to make the temperature of the first and second heater units quickly reach the target temperature, commonly controls the first heater unit and the second heater unit based on the temperature measured by the first sensor that is a temperature sensor sensitive to the temperature change when the fusing is performed, thereby performing the accurate temperature control on the side of the heating roller.

Figure 2:
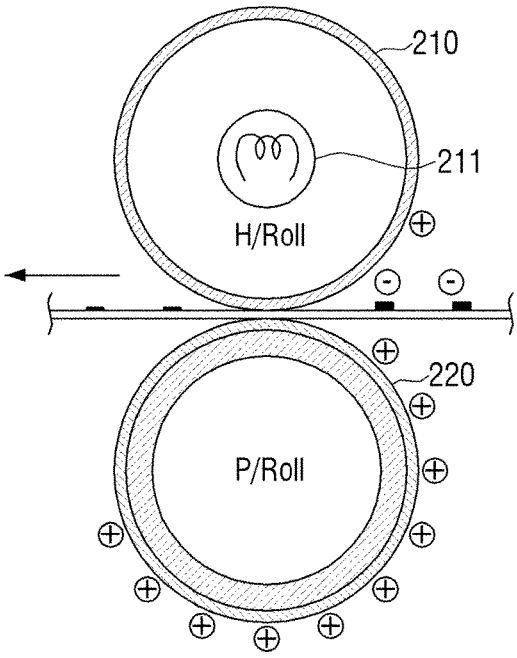
FIGS. 2 to 5 are diagrams for describing a form of a fuser of FIG. 1.
Figure 3:
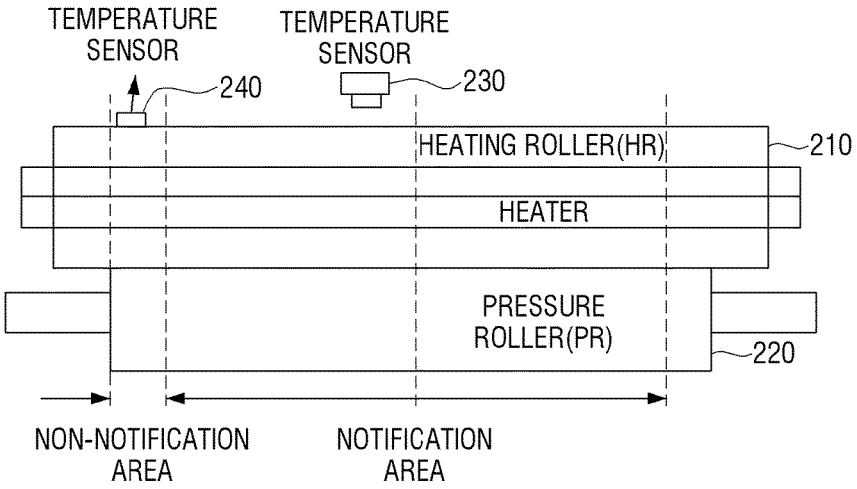
Figure 4:
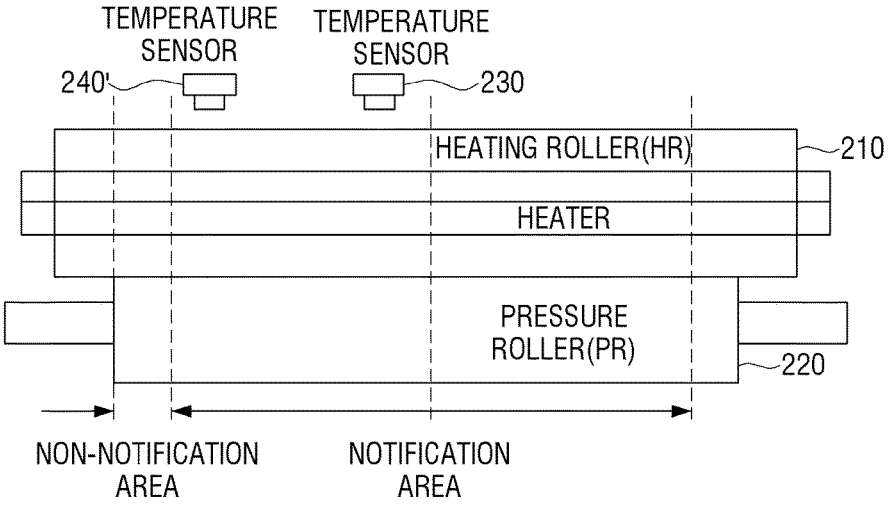
Figure 5:
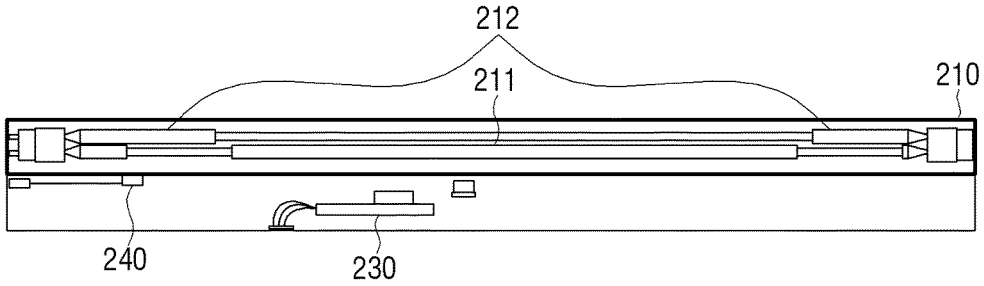

FIGS. 2 to 5 are diagrams for describing a form of the fuser of FIG. 1. In detail, FIG. 2 is a diagram illustrating the side form of the fuser, FIGS. 3 and 4 are diagrams illustrating a disposition form of the sensor for detecting the temperature of the heating roller, and FIG. 5 is a diagram illustrating a disposition form of the heater unit within the heating roller.

Referring to FIGS. 2 to 5, the fuser 200 applies heat and pressure to printing paper to fuse a charge toner on printing paper to the printing paper. In detail, the fuser 200 is configured to include a heating roller 210, a pressure roller 220, a first sensor 230, and a second sensor 240.

The heating roller 210 is heated to a predetermined temperature to provide heat to the printing paper so that the charge toner on the printing paper is easily fused. In detail, in the heating roller 210, a first heater unit 211 and a second heater unit 212 may be positioned in a cylindrical base and an elastic layer and a release layer may be disposed on the base.

The first heater unit 211 is disposed at a center with respect to a vertical direction (that is, axis direction of the heating roller) to a direction in which the printing paper moves. For example, the first heater unit 211 may have a length corresponding to a narrow length of A4 sheet.

The second heater units 212 are disposed on both sides of the first heater unit 211 not to overlap the first heater unit 211, with respect to the vertical direction to the direction in which the printing paper moves. For example, the second heater unit 212 may be configured in two of a ½ length of a length that is a subtraction of a narrow length of A4 sheet from a wide length of A4 sheet.

The pressure roller 220 provides a high pressure to the printing paper so that the charge toner on the printing paper may be easily fused. In detail, a surface of the pressure roller 220 may be attached with a heating roller 210 to maintain a predetermined nip 113. Further, in the pressure roller 220, the elastic layer and the release layer may be disposed on a cylindrical core metal.

The first sensor 230 detects a temperature of a central area of the heating roller 210. Here, the central area is a notification area through which the printing paper passes. That is, the central area is an area through which paper passes, and therefore to prevent image deterioration due to the sensor contact, the first sensor 230 is preferably a non-contacting temperature sensor that does not contact the heating roller 210.

The second sensor 240 detects a temperature of a side area of the heating roller. Here, the side area may be the notification area through which paper passes or a non-notification area through which paper does not pass. If the side area is the notification area, to prevent the image deterioration due to the sensor contact, a second sensor 240' is preferably implemented as a non-contacting temperature sensor as illustrated in FIG. 4.

However, if the side area is the non-notification area, the second sensor 240 may be implemented as a contacting temperature sensor contacting the surface of the heating roller as illustrated in FIG. 3. Meanwhile, the exemplary embodiment of the present disclosure describes that if the side area is the non-notification area, the second sensor 240 may be implemented as the contacting temperature sensor, but in the implementation, the second sensor 240 may also be implemented as the non-contacting temperature sensor.

Meanwhile, the case in which only two heater units are provided in the heating roller 210 is illustrated and described above, but in the implementation, at least three heater units may be provided. In this case, at least three sensors may also be provided.

Meanwhile, when the sensor is disposed in the non-notification area, since a temperature difference between a side non-notification area and a notification area is changed over time, that is, the temperature difference in the early stage of printing and the temperature difference in the middle and end of printing are different, it is difficult to perform the heater control for the axial uniform temperature distribution of the heating roller.

The heat quantity control is performed using only the temperature measured by the first sensor 230 in consideration of the different temperature difference and the second heater unit 212 may perform the control to turn off the second heater unit only when the temperature of the second sensor 240 rises to a reference temperature or higher. However, the problems will be described below with reference to FIGS. 6 and 7.

Figure 6:
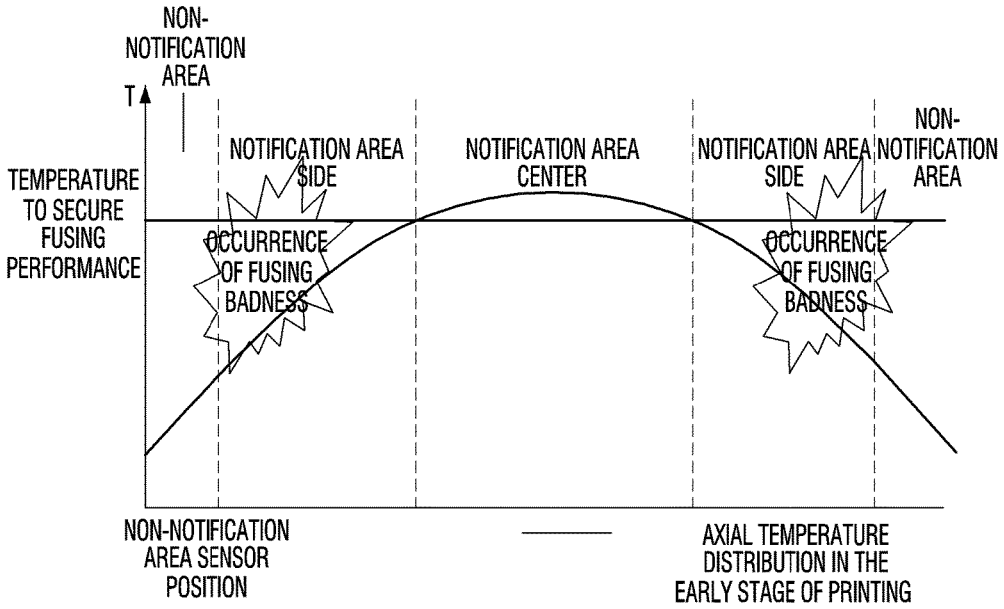
FIG. 6 is a diagram illustrating a temperature distribution at an early stage of temperature rising when a heat quantity of a heater is controlled by only a central sensor.
Figure 7:
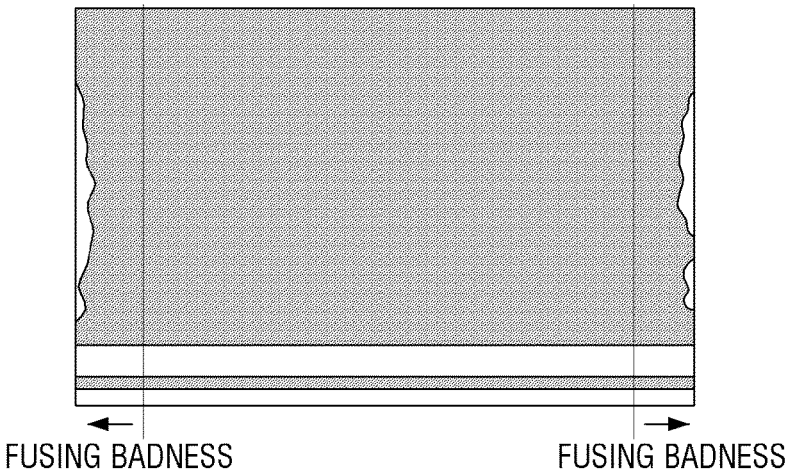
FIG. 7 is a diagram illustrating an example of a printed image at an early state of temperature rising of FIG. 6.

FIG. 6 is a diagram illustrating a temperature distribution at an early stage of temperature rising when a heat quantity control of a heater is performed by only a central sensor. FIG. 7 is a diagram illustrating an example of a printed image at an early state of temperature rising.

Referring to FIGS. 6 and 7, even though the heating value of the heater is uniform in an axis direction during the preheating process of performing temperature rising from initial low temperature, since an external heat loss is larger at both side portions, a temperature rising speed of both side portions is slower than that of a central portion. Further, after the temperature of the central portion reaches the reference target temperature, the temperature of both side portions slowly rises to reach the reference target temperature. In this case, if the printing is merely performed when the central temperature reaches the reference setting temperature, the fusing badness occurs at both side portions as illustrated in FIG. 7. As a result, to secure the fusing performance of the central portion and both side portions of the image, it takes much time to make the temperature of both side portions reach the reference setting temperature, which increases FPOT.

Meanwhile, to solve the problem of the case of using one sensor value, the first heater unit may be controlled using a value of the first sensor and the second heater unit may be controlled using a value of the second sensor. However, there is a problem even in the case of individually controlling the two heater units. The problem in this case will be described below with reference to FIGS. 8 and 9.

Figure 8:
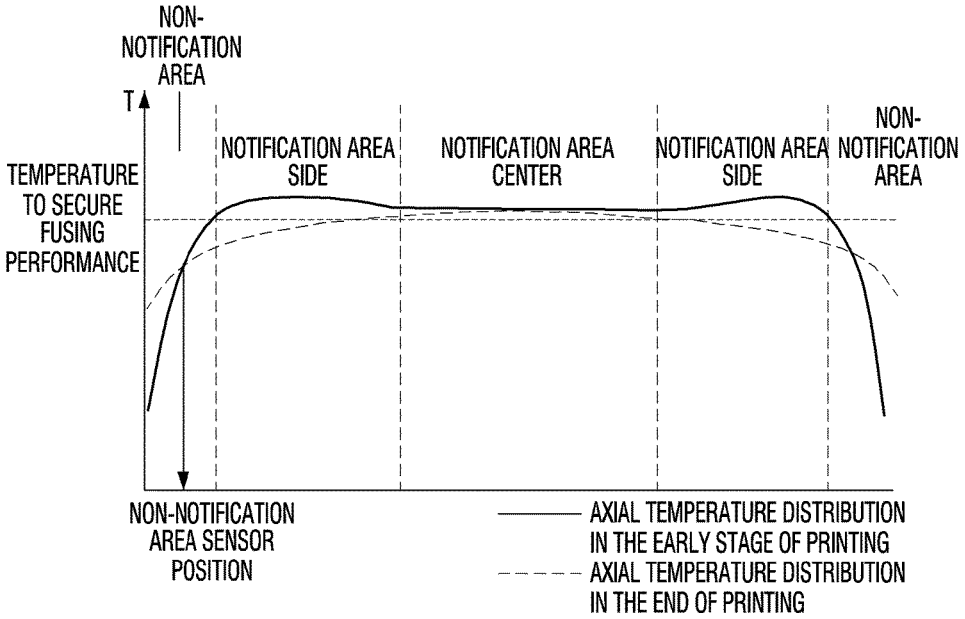
FIG. 8 is a diagram illustrating a temperature distribution in the middle and end of temperature rising when a low side target temperature is set.
Figure 9:
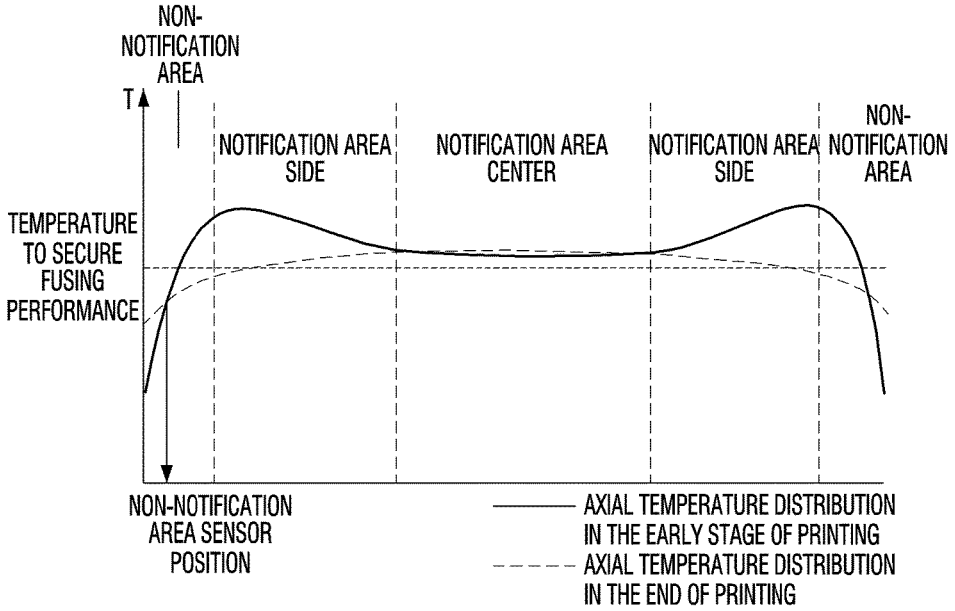
FIG. 9 is a diagram illustrating a temperature distribution in the middle and end of temperature rising when a high side target temperature is set.

FIG. 8 is a diagram illustrating a temperature distribution in the middle and end of temperature rising when a low side target temperature is set. FIG. 9 is a diagram illustrating a temperature distribution in the middle and end of temperature rising when a high side target temperature is set.

Referring to FIGS. 8 and 9, if the second sensor is disposed in the non-notification area, since heat is transferred to the notification area to change temperature, the temperature change is relatively slower than the notification area, which causes the problem that the temperature difference between the temperature of the side notification area and the temperature of the side non-notification area is not constant over time. That is, the temperature difference in the early stage of printing and the temperature difference in the middle and end of printing cause different results and these characteristics make the setting of the side target temperature difficult.

Therefore, since the temperature difference between the side notification area and the side non-notification area is large in the early stage of printing, when the side target temperature is set to be temperature at which the initial fusing performance may be secured, the temperature difference between the two areas is reduced as the printing is performed.

As a result, the temperature of the side notification area is lower than the temperature required to secure the fusing performance as illustrated in FIG. 8, thereby causing the fusing badness.

In this respect, to secure the fusing performance in the early stage of printing and in the middle and end of printing, the side target temperature may be set to the temperature at which the fusing performance may be secured in the middle and end of printing, but as illustrated in FIG. 9, this incurs the high temperature rising along with the excessive supply of heat quantity to the second heater unit in the early stage of printing, which may cause the hot offset in the early stage of printing or increase the amount of curl of paper.

Therefore, in the heat quantity control method according to the exemplary embodiment of the present disclosure, different control schemes are applied according to a temperature section of the second sensor 240 (or side sensor). Basically, the difference between the target temperature and the sensor temperature value is divided into several sections and the heat quantity of the heater unit is controlled using the table in which an appropriate duty amount is set in each section, but a method for determining heat quantities of each heater unit is changed according to the temperature value of the second sensor 240. The heat quantity control method according to the exemplary embodiment of the present disclosure will be described below in detail with reference to FIG. 10.

Figure 10:
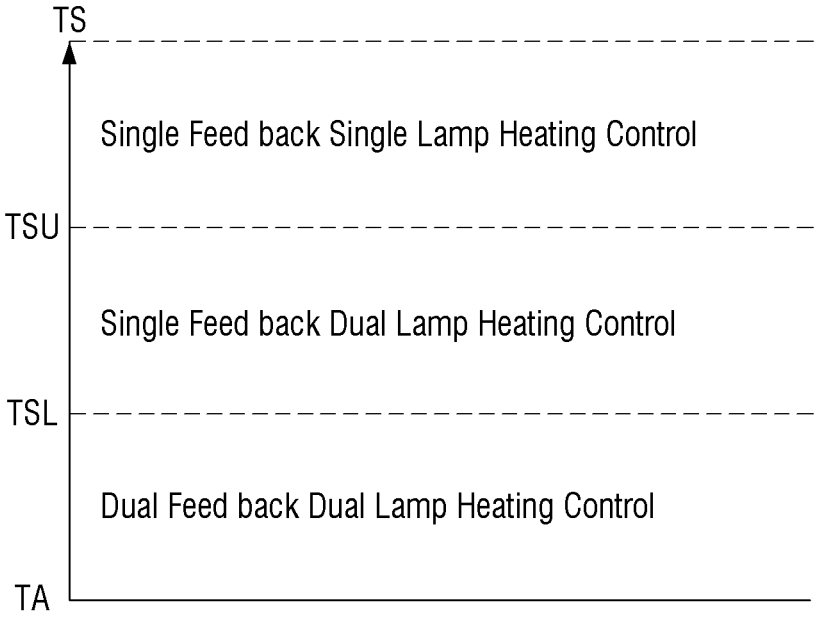
FIG. 10 is a diagram for describing a heat quantity control method according to a first exemplary embodiment of the present disclosure.

FIG. 10 is a diagram for describing a heat quantity control method according to a first exemplary embodiment of the present disclosure.

Referring to FIG. 10, the heat quantity control of the plurality of heater units may be divided into the following three sections according to the temperature value of the second sensor 240.

First Section (Dual Feed Back Dual Lamp Heating Control)

This may be applied in the case in which temperature TS of second sensor≤predetermined first temperature TSL. Here, the first temperature is a lower bound of a temperature range in which the side area of the heating roller may normally perform the fusing.

In the first section, the heating value may be set in the first heater unit 211 based on the temperature difference between the temperature TC of the first sensor and a central target temperature TGC.

In the first section, the heating value may be set in the second heater unit 212 based on the temperature difference between the temperature TS of the second sensor and a side target temperature TGS.

Second Section (Single Feed Back Dual Lamp Heating Control)

This may be applied in the case in which predetermined first temperature TSL<temperature TS of second sensor≤predetermined second temperature TSU. Here, the second temperature is an upper bound of a temperature range in which the side area of the heating roller may normally perform the fusing and may be the side target temperature.

In the second section, the heating value may be set in the first heater unit 211 based on the temperature difference between the temperature TC of the first sensor and a central target temperature TGC.

In the second section, the heating value may be set in the second heater unit 212 based on the temperature difference between the temperature TC of the first sensor and the side target temperature TGS.

Third Section (Single Feed Back Dual Lamp Heating Control)

This may be applied in the case in which predetermined second temperature TSU<temperature TS of second sensor.

In the third section, the heating value may be set in the first heater unit 211 based on the temperature difference between the temperature TC of the first sensor and the central target temperature TGC.

In the third section, the supply of power to the second heater unit 212 may be cut off.

According to the division of the control scheme, the relationship between a temperature of an end notification area of the heating roller and a temperature of the non-notification areas minimizes the effect of different characteristics in the early stage of printing and the middle and end of printing, thereby facilitating the setting of the predetermined first temperature TSL.

Further, when TS<TSL, the heat quantity of the second heater unit 212 is set to quickly increase temperature based on the difference between the temperature TS of the second sensor and the predetermined first temperature TSL regardless of the temperature of the first sensor 230, thereby preventing the fusing badness in the early stage of printing and securing another FPOT.

Further, in the case of TSL<TS≤TSU, the temperature change due to the movement of printing paper commonly occurs at the central portion and the side portion, and therefore the appropriate temperature control may be performed on the first heater unit 211 and the second heater unit 212 based on the temperature TC of the first sensor.

Further, in the case of TSU<TS, the second heater unit 212 may be turned off to prevent the side portion of the heating roller from overheating.

Hereinafter, the effect of the heat quantity control method according to the first exemplary embodiment of the present disclosure will be described with reference to FIGS. 11 to 13.

Figure 12:
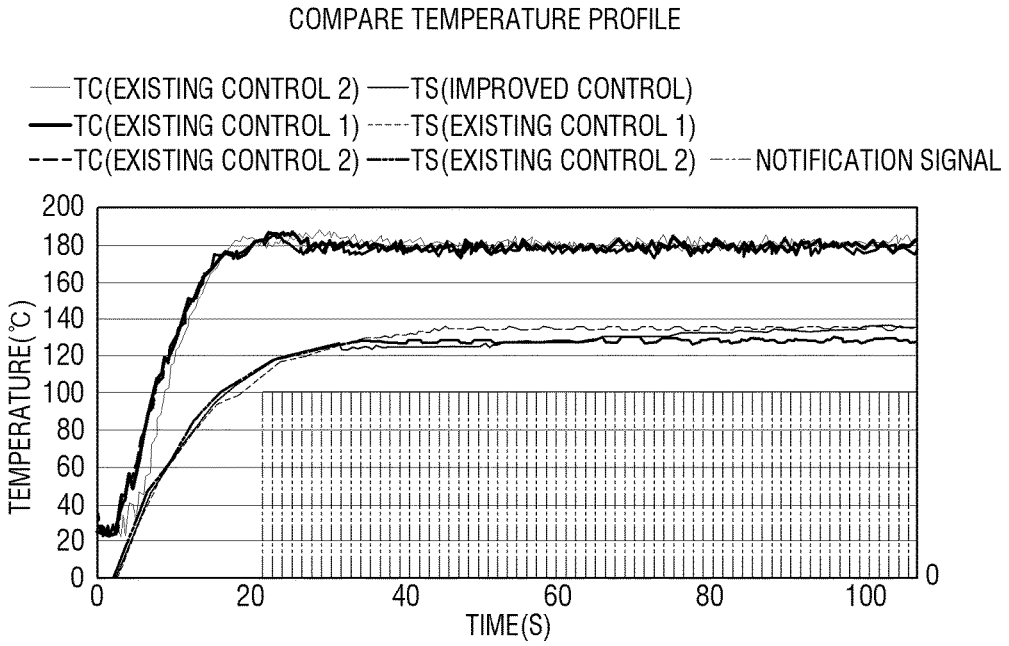
Figure 13:
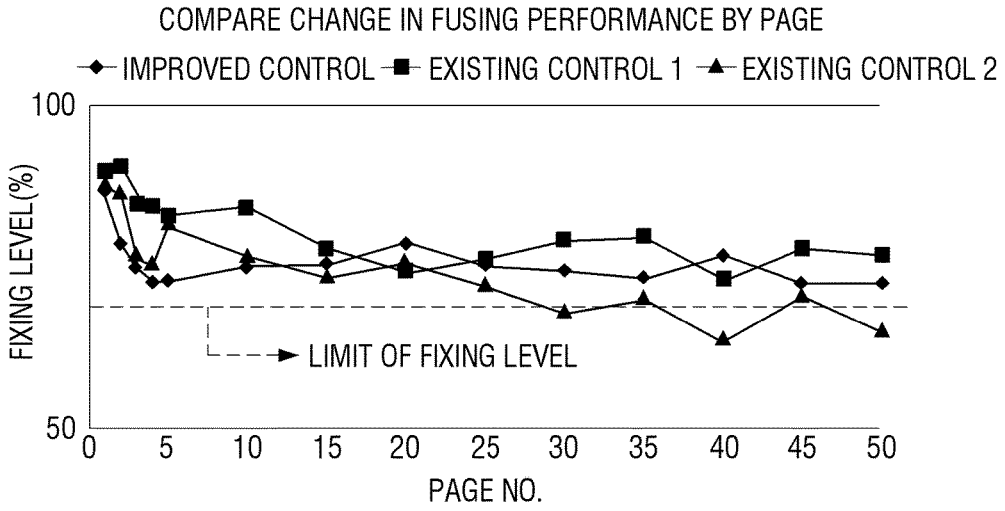

FIGS. 11 to 13 are diagrams for describing an effect of the heat quantity control method according to the first exemplary embodiment of the present disclosure. In detail, FIG. 11 is a diagram illustrating control conditions of the existing control method and the control method according to the exemplary embodiment of the present disclosure. Further, FIG. 12 is a comparison diagram of printing temperature profiles according to the existing control method and the control method according to the exemplary embodiment of the present disclosure. FIG. 13 is a diagram illustrating the change in fusing performance of each of the existing control method and the control method according to the exemplary embodiment of the present disclosure.

First, comparing the existing control condition 1 and the existing control condition 2, the problem of the side target temperature setting by the existing control method may be confirmed. In detail, when the side target temperature TGS is set to be low, even though the side temperature in the end of printing is higher than the printing time of a first page, as illustrated in FIG. 13, it can be confirmed that as the printing is progressed, the fusing performance is reduced. On the other hand, it can be appreciated that when the side target temperature TGS is set to be high, a heat quantity more than the required heat quantity in the early stage of printing is applied to the second heater unit to cause the unnecessary power consumption while excessively increasing temperature in the early stage of printing.

Meanwhile, referring to FIGS. 11 to 13, it can be appreciated that the heat quantity control method according to the exemplary embodiment of the present disclosure keeps the fusing performance at a stable level even in the end of printing while securing the temperature profile and the fusing performance similar to the existing control 2 in the early stage of printing.

That is, it is possible to obtain better fusing performance than the existing scheme from the early stage of printing to the end of printing by supplying the appropriate heat quantity even in the middle and end of printing while preventing the temperature of the side portion of the heating roller from excessively rising and preventing the unnecessary power consumption in the early stage of printing.

The case in which the heat quantity control is performed in consideration of only the temperature of the heating roller is described above, but the temperature of the pressure roller also affects the fusing performance of the printed image. In detail, the heating roller supplies heat to the toner layer and the paper layer, but some of the supplied heat is discharged to the pressure roller and used to increase the temperature of the pressure roller.

Further, as the temperature of the pressure roller rises, the temperature difference between the paper and the pressure roller is reduced in the nip, and therefore more heat is used to melt the toner. Therefore, as the temperature of the pressure roller rises, the temperature of the heating roller is lowered, thereby reducing the power consumption required for the printing.

For this purpose, there may be the case in which the sensor for measuring the temperature of the pressure roller is additionally mounted. In this case, since cost is increased due to the increase in the required number of sensors, a control to predict the heat quantity of the pressure roller based on the number of copies to be printed to adjust a target temperature of the heater depending on the number of copies is generally used widely.

In detail, the above-mentioned existing scheme confirms the number of copies to be printed at each control step to set the target temperature and then determines the heat quantity of the heater unit based on the difference between the set target temperature (central target temperature TGC and side target temperature TGS) and the temperature values of each sensor.

The existing scheme is highly likely to cause an error in the temperature prediction of the pressure roller, and therefore may cause the inefficient power consumption when the printing is not continuously performed and may cause the printed image deterioration.

Further, if the temperature of the pressure roller reaches a saturated state and then the printing is performed and a power supply of the image forming apparatus is cut off and then is immediately turned on and the printing job is again performed, the temperature of the pressure roller is set to be in a cold state. therefore the problem in that the heat quantity more than the required heat quantity is supplied even though the actual temperature of the pressing roller is high may occur.

Further, the image forming apparatus performs printing and then maintains a standby state without performing the printing for quite a while and thus when the temperature of the pressure roller is low, it is difficult to determine the step depending on the number of copies to be printed over the standby state time.

Therefore, according to the exemplary embodiment of the present disclosure, the target temperature is adjusted using the temperature of the second sensor representing the temperature of the pressure roller without additionally using the separate temperature sensor.

In detail, in the fuser structure according to the exemplary embodiment of the present disclosure, the second sensor 240 is positioned in the non-notification area of the side of the heating roller 210. The non-notification area of the heating roller 210 is an area directly contacting the pressure roller and is affected by the temperature of the pressure roller.

Meanwhile, according to the exemplary embodiment of the present disclosure, the first and second heater units are controlled based on only the temperature value of the first sensor at the first temperature or higher, and therefore the side temperature change is not greatly changed by the heat quantity control of the heater unit. As a result, the effect of the temperature of the pressure roller is relatively increased.

In this regard, the exemplary embodiment of the present disclosure may indirectly predict the temperature of the pressure roller based on the temperature value of the second sensor 240.

Figure 14:
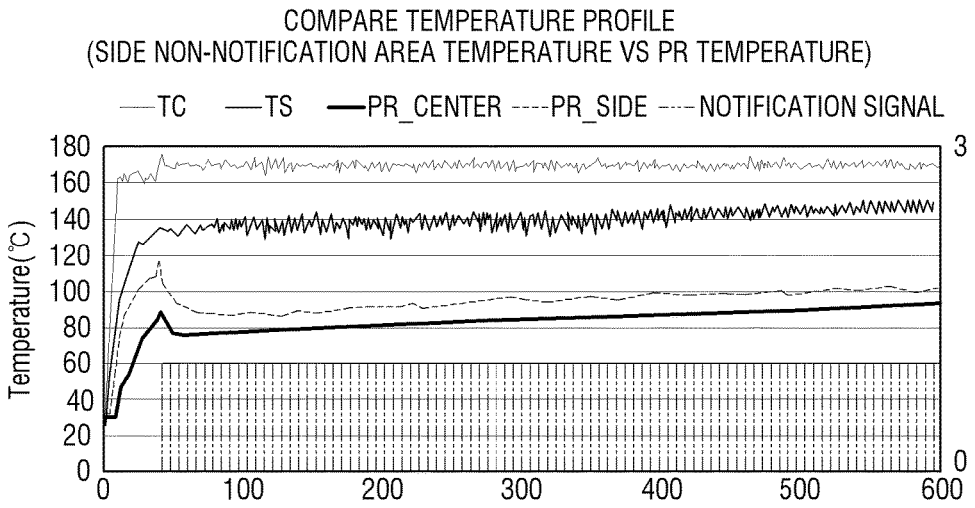
FIG. 14 is a diagram for describing a temperature change of a pressure roller at the time of continuous fusing.

FIG. 14 is a diagram for describing the temperature change of the pressure roller at the time of continuous fusing.

Referring to FIG. 14, it can be confirmed that the temperature change of the second sensor in the section in which the temperature of the second sensor is equal to or higher than the predetermined first temperature is similar to the temperature change of the pressure roller. That is, the temperature of the pressure roller may be indirectly found based on the temperature change of the second sensor, and therefore the heat quantity control may be made in consideration of the temperature of the pressure roller based thereon.

Figure 15:
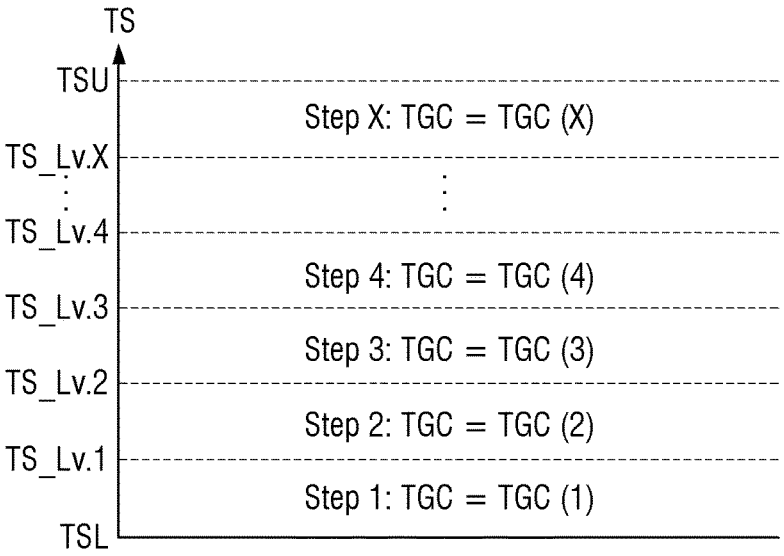
FIG. 15 is a diagram for describing a heat quantity control method according to a second exemplary embodiment of the present disclosure.
Figure 21:
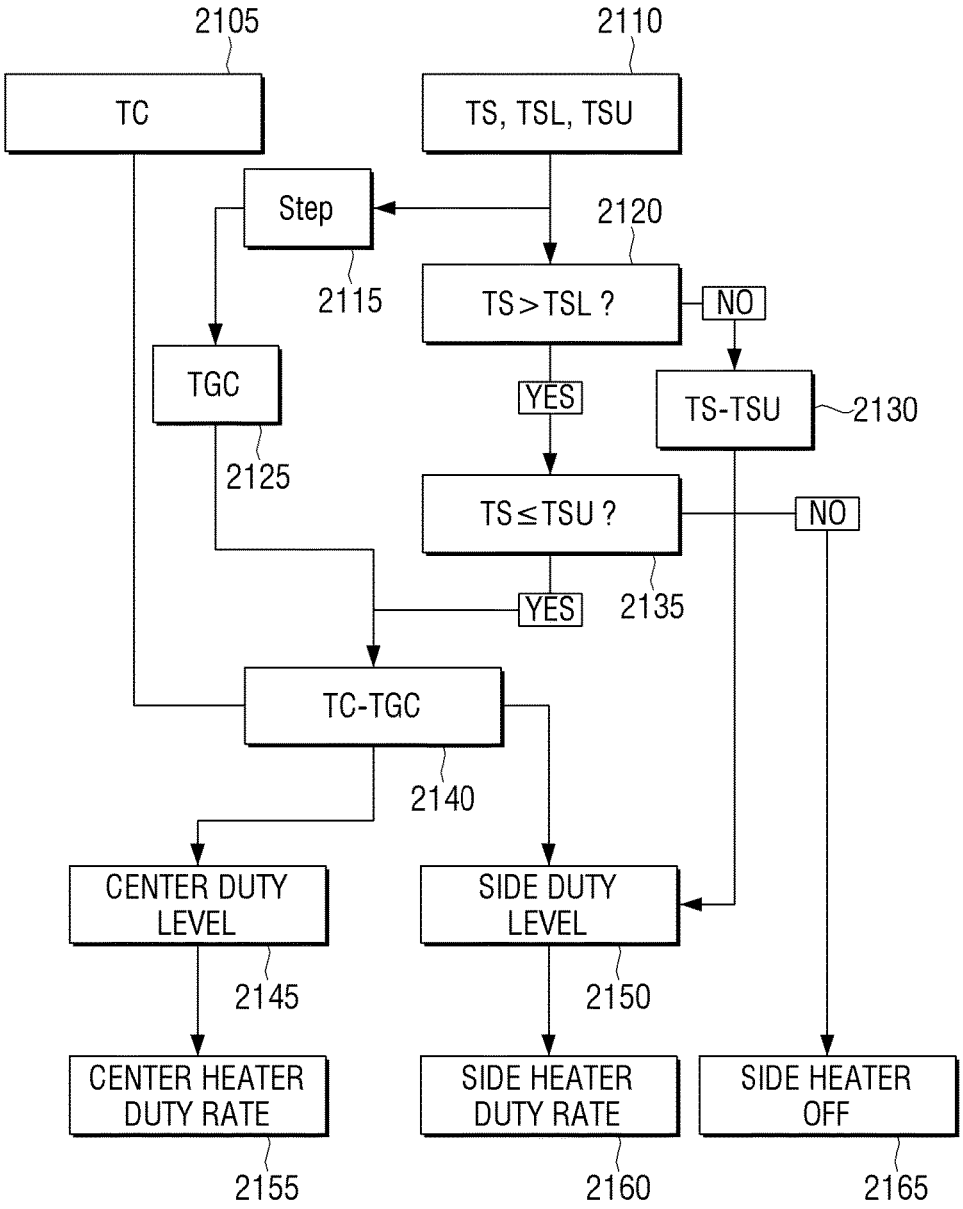
FIG. 21 is a flow chart for describing a heat quantity control method according to the second exemplary embodiment of the present disclosure.

As illustrated in FIG. 15, the heat quantity control scheme according to the second exemplary embodiment of the present disclosure may divide the section of the predetermined first temperature TSL and second temperature TSU into several sections and set the target temperature meeting each section to control the heat quantities of each heater unit, when the temperature TS of the second sensor is between the predetermined first temperature TSL and the predetermined second temperature TSU. The detailed heat quantity control method according to the second exemplary embodiment of the present disclosure is illustrated in FIG. 21.

Figure 16:
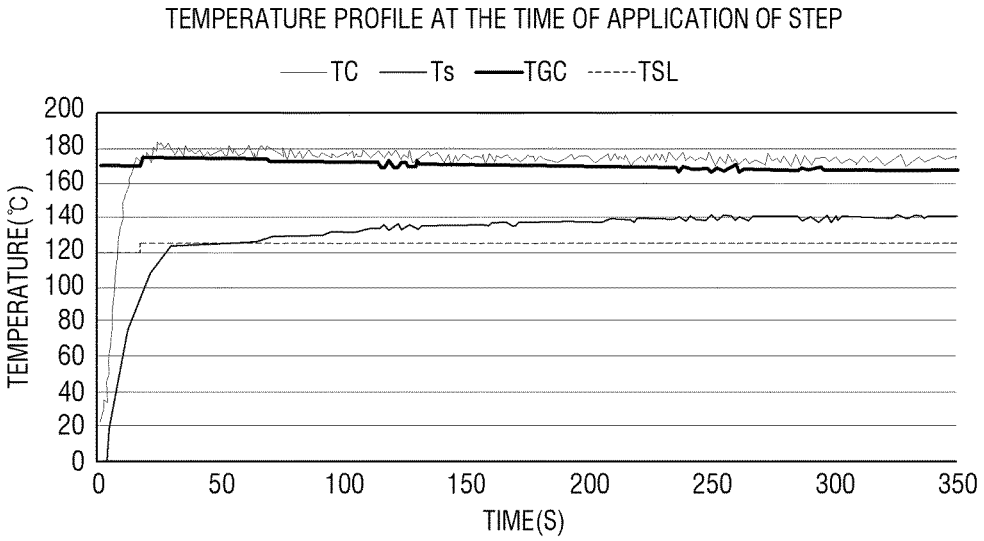
FIGS. 16 and 17 are diagrams for describing an effect of the heat quantity control method according to the second exemplary embodiment of the present disclosure.
Figure 17:
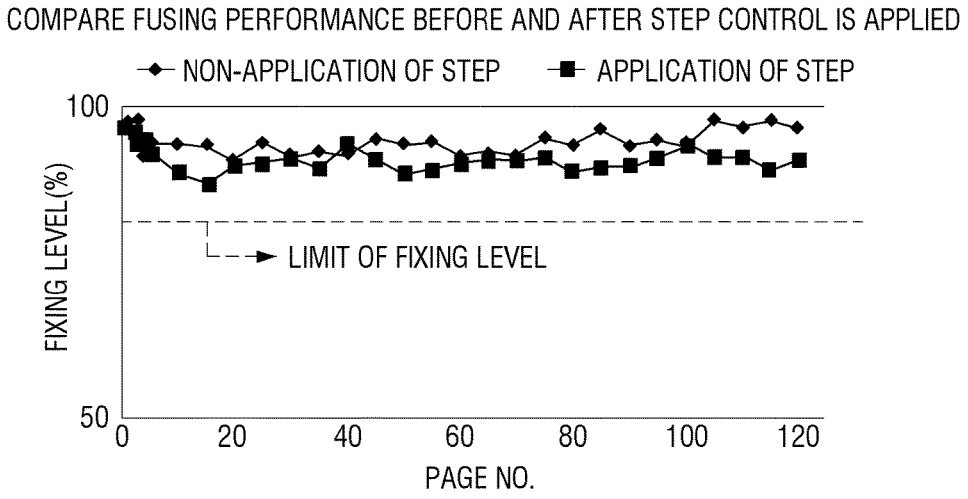

FIGS. 16 and 17 are diagrams for describing an effect of the heat quantity control method according to the second exemplary embodiment of the present disclosure.

Referring to FIGS. 16 and 17, when the heat quantity control according to the second exemplary embodiment of the present disclosure is not applied, it can be appreciated that the fusing performance tends to be slightly increased depending on the printing progress but when the heat quantity control according to the second exemplary embodiment of the present disclosure is applied, it can be appreciated that the fusing performance is uniformly maintained and it can be confirmed that the temperature of the heating roller is gradually reduced.

Meanwhile, one of the important items in controlling the heater unit of the image fusing apparatus that fuses a non-fused toner image to the recording paper is a method for preventing overheating due to a malfunction of a heater.

The overheating mainly occurs by a misrecognition of the temperature sensor due to the malfunction of the heater and may occur due to external factors since the sensor is mainly disposed outside the heating roller. For example, when the image fusing apparatus is driven in the state in which paper is not completely removed in the case in which a jam occurs during the printing, if the non-removed paper is disposed between the sensor and the heating roller, the sensor may incur the overheating due to the malfunction of the heater while recognizing the temperature as being lower than the actual temperature of the heating roller.

However, the exemplary embodiment of the present disclosure may prevent the overheating operation using the temperature value of the second sensor. In detail, the second sensor 240 of the fuser according to the exemplary embodiment of the present disclosure may be disposed in the non-notification area regardless of the transfer of paper. In this case, there is no misrecognition of the temperature due to paper rather than the second sensor 240 disposed in the notification area, and therefore the overheating may be prevented due to the misrecognition of the temperature using. The operation of detecting the overheating of the fuser based on the temperature value of the second sensor will be described below with reference to FIG. 18.

Figure 18:
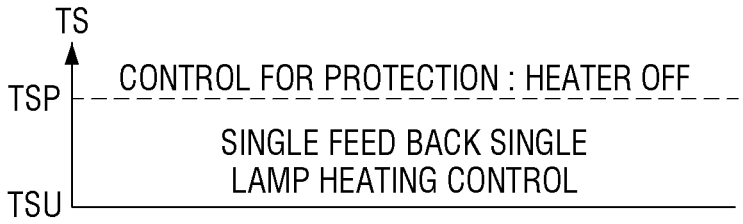
FIG. 18 is a diagram for describing a heat quantity control method according to a third exemplary embodiment of the present disclosure.

FIG. 18 is a diagram for describing a heat quantity control method according to a third exemplary embodiment of the present disclosure.

Referring to FIG. 18, a method for preventing a heater from overheating using a temperature value of a second sensor will be described. In detail, if the temperature TS of the second sensor reaches a third temperature TSP or higher preset to be higher than the predetermined second temperature, the transfer of paper stops and the supply of power to both of the first heater unit and the second heater unit is cut off, thereby preventing the overheating due to the misrecognition of the first sensor.

Figure 19:
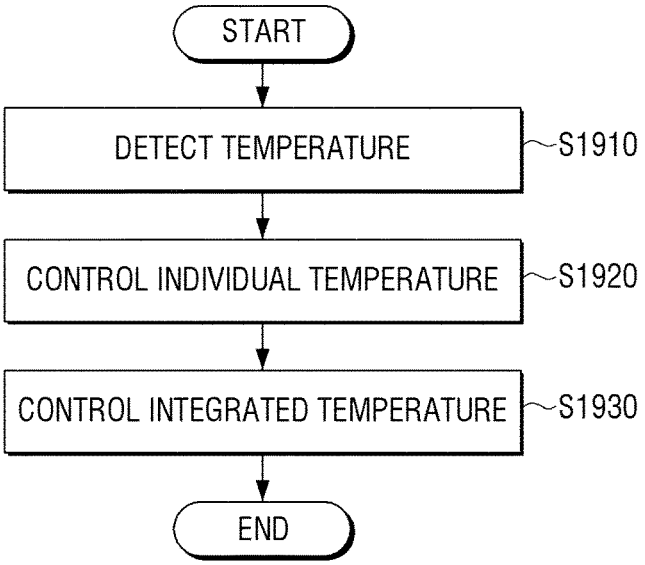
FIG. 19 is a flow chart for describing an example of a fuser driving control method of an image forming apparatus according to an exemplary embodiment of the present disclosure.

FIG. 19 is a flow chart for describing an example of a fuser driving control method of an image forming apparatus according to an exemplary embodiment of the present disclosure.

Referring to FIG. 19, the temperature of each of the central area and the side area of the heating roller is sensed (S1910). In detail, the temperature of the central area of the heating roller may be sensed using the first sensor detecting the temperature of the central area of the heating roller and the temperature of the side area of the heating roller may be sensed using the second sensor detecting the temperature of the side area of the heating roller.

Here, the central area may be the notification area through which paper passes and the side area may be the notification area through which paper passes or the non-notification area through which paper does not pass. If the side area is the notification area, the second sensor may be implemented as the non-contacting temperature sensor and if the side area is the non-notification area, the second sensor may be implemented as the contacting temperature sensor contacting the surface of the heating roller.

Further, if the temperature measured by the second sensor is less than the predetermined first temperature, the first heater unit and the second heater unit may be individually controlled according to the respective temperatures measured by the first sensor and the second sensor (S1920). In detail, the first heating value is set based on the temperature difference between the temperature measured by the first sensor and the central target temperature to control the first heater unit and the second heating value is set based on the temperature difference between the temperature measured by the second sensor and the side target temperature, thereby controlling the second heater unit. Here, the predetermined first temperature is the lower bound of the temperature range in which the side area of the heating roller may normally perform the fusing.

Further, if the temperature measured by the second sensor is equal to or higher than the predetermined first temperature, the first heater unit and the second heater unit are commonly controlled according to the temperature measured by the first sensor (S1930). In detail, the third heating value may be set based on the temperature difference between the temperature measured by the first sensor and the central target temperature to commonly control the first heater unit and the second heater unit.

Meanwhile, if the temperature measured by the second sensor is equal to or higher than the second temperature higher than the first temperature, only the first heater unit may be controlled according to the temperature measured by the first temperature to cut off the supply of power to the second heater unit. Meanwhile, if the temperature measured by the second sensor is equal to or higher than the third temperature higher than second temperature, it is determined that the fuser overheats and the supply of power to both of the first heater unit and the second heater unit may be cut off. Here, the second temperature is an upper bound of a temperature range in which the side area of the heating roller may normally perform the fusing.

As described above, the fuser driving control method according to the exemplary embodiment of the present disclosure individually controls the first heater unit and the second heater unit at the time of the initial driving of the fuser to make the first and second heater units quickly reach the target temperature, commonly controls the first heater unit and the second heater unit based on the temperature measured by the temperature sensor that is sensitive to the temperature change when the fusing is performed, thereby performing the accurate temperature control on the side of the heating roller. The fuser driving control method as illustrated in FIG. 19 may be performed on the image forming apparatus having the configuration of FIG. 1 and may also be performed on the image forming apparatus having other configurations.

Figure 20:
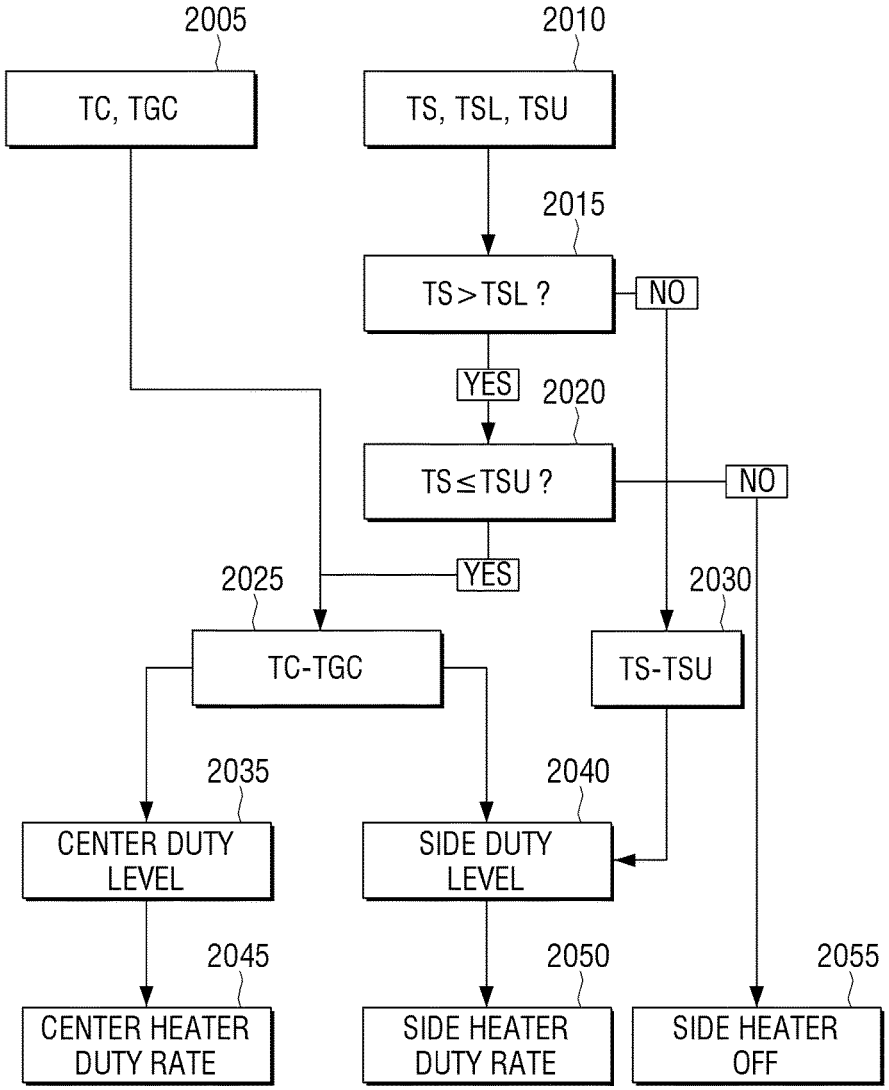
FIG. 20 is a flow chart for describing a heat quantity control method according to the first exemplary embodiment of the present disclosure.

FIG. 20 is a flow chart for describing a heat quantity control method according to the first exemplary embodiment of the present disclosure. In detail, the heat quantity control method according to the first exemplary embodiment of the present disclosure is an embodiment in which the temperature change of the pressure roller is not considered.

First, the central target temperature TGC is set and the temperature TC of the first sensor detecting the temperature of the central area of the heating roller is sensed (S2005). Here, the first sensor is the non-contacting temperature sensor that does not contact the heating roller.

Further, the side target temperature TSU and the predetermined first temperature TSL are set and the temperature TS of the second sensor detecting the temperature of the side area of the heating roller is sensed (S2010). Here, the first temperature is the lower bound of the temperature range in which the side area of the heating roller may normally perform the fusing.

Further, the second sensor may be disposed in the notification area through which the printing paper passes. In this case, the second sensor may be the non-contacting temperature sensor that does not contact the heating roller. However, if the second sensor is disposed in the non-contacting area through which the printing paper does not pass, the second sensor may be the contacting temperature sensor that contacts the heating roller.

Further, it is determined whether the measured temperature TS of the second sensor is larger than the predetermined first temperature TSL (S2015).

As the determination result, if the temperature TS of the second sensor is smaller than the preset first temperature TSL (S2015-N), the second heating value may be set based on the difference between the temperature TS of the second sensor and the side target temperature TSU (S2030). Meanwhile, the exemplary embodiment of the present disclosure describes that the second heating value is set using the difference from the side target temperature, but in the implementation, the second heating value may also be set using the difference from the first temperature.

Further, the second heater unit may be controlled by adjusting a duty for the second heater unit heating the side area of the heating roller depending on the set second heating value (S2040 and S2050).

In this case, the first heating value is set based on the difference between the temperature TC of the first sensor and the central target temperature TGC (S2025) and the duties for the first heater unit heating the central area of the heating roller are adjusted based on the set first heating value, thereby controlling the first heater unit (S2035 and S2045).

Meanwhile, if the temperature TS of the second sensor is larger than the predetermined first temperature TSL, it is determined whether the temperature TS of the second sensor is smaller than the predetermined second temperature (S2020). Here, the predetermined second temperature may be the side target temperature (TSU).

As the determination result, if the measured temperature TS of the second sensor is larger than the predetermined first temperature and is smaller than the predetermined second temperature (S2020-Y), the third heating value is set based on the difference between the temperature TC of the first sensor and the central target temperature TGC (S2025) and the duties for the first heater unit and the second heater unit heating the central area of the heating roller are commonly adjusted based on the set third heating value, thereby commonly controlling the first heater unit and the second heater unit (S2035, S2040, S2045, and S2050).

Meanwhile, if the measured temperature TS of the second sensor is larger than the predetermined second temperature TSU (S2020-N), the supply of power to the second heater unit is cut off and only the first heater unit may be controlled (S2055).

As described above, the heat quantity control method according to the first exemplary embodiment of the present disclosure individually controls each of the central and side heaters at the time of the initial driving of the heating roller to quickly increase the temperature, thereby reducing the fusing standby time. Further, the central and side heaters are commonly controlled according to the central temperature when the heating roller reaches the fusible temperature, and therefore even the contacting temperature sensor that is disposed in the non-notification area may prevent the side portion from overheating and secure the fusing performance in the end of printing. In addition, it is possible to improve costs and increase the energy efficiency by using the contacting temperature sensor. The heat quantity control method as illustrated in FIG. 20 may be performed on the image forming apparatus having the configuration of FIG. 1 and may also be performed on the image forming apparatus having other configurations.

FIG. 21 is a flow chart for describing a heat quantity control method according to the second exemplary embodiment of the present disclosure. In detail, the heat quantity control method according to the second exemplary embodiment of the present disclosure is an embodiment in which the temperature change of the pressure roller is considered.

First, the temperature TC of the first sensor detecting the temperature of the central area of the heating roller is sensed (S2105). Here, the first sensor is the non-contacting temperature sensor that does not contact the heating roller.

Further, the side target temperature TSU and the predetermined first temperature TSL are set and the temperature TS of the second sensor detecting the temperature of the side area of the heating roller is sensed (S2110). Here, the first temperature is the lower bound of the temperature range in which the side area of the heating roller may normally perform the fusing and the side target temperature is the upper bound of the temperature range in which the side area of the heating roller may normally perform the fusing.

Further, the second sensor may be disposed in the notification area through which the printing paper passes. In this case, the second sensor may be the non-contacting temperature sensor that does not contact the heating roller. However, if the second sensor is disposed in the non-contacting area through which the printing paper does not pass, the second sensor may be the contacting temperature sensor that contacts the heating roller.

Further, it is determined to which area in the plurality of temperature ranges as illustrated in FIG. 15 the temperature TS of the second sensor belongs (S2115) and the central target temperature TGC set in the temperature range to which the measured temperature TS of the second sensor corresponds may be set (S2125).

Further, it is determined whether the measured temperature TS of the second sensor is larger than the predetermined first temperature TSL (S2120).

As the determination result, if the temperature TS of the second sensor is smaller than the preset first temperature TSL (S2120-N), the second heating value may be set based on the difference between the temperature TS of the second sensor and the side target temperature TSU (S2130). Meanwhile, the exemplary embodiment of the present disclosure describes that the second heating value is set using the difference from the side target temperature TSU, but in the implementation, the second heating value may also be set using the difference from the first temperature TSL.

Further, the second heater unit may be controlled by adjusting a duty for the second heater unit heating the side area of the heating roller depending on the set second heating value (S2150 and S2160).

In this case, the first heating value is set based on the difference between the temperature TC of the first sensor and the central target temperature TGC varying according to the temperature of the second sensor (S2140) and the duties for the first heater unit heating the central area of the heating roller are adjusted based on the set first heating value, thereby controlling the first heater unit (S2145 and S2155).

Meanwhile, if the temperature TS of the second sensor is larger than the predetermined first temperature TSL, it is determined whether the temperature TS of the second sensor is smaller than the predetermined second temperature (S2135). Here, the predetermined second temperature may be the side target temperature (TSU).

As the determination result, if the measured temperature TS of the second sensor is larger than the predetermined first temperature and is smaller than the predetermined second temperature (S2135-Y), the third heating value is set based on the difference between the temperature TC of the first sensor and the central target temperature TGC varying according to the temperature of the second sensor (S2140) and the duties for the first heater unit and the second heater unit heating the central area of the heating roller are commonly adjusted based on the set third heating value, thereby commonly controlling the first heater unit and the second heater unit (S2145, S2155, S2150, and S2160).

Meanwhile, if the measured temperature TS of the second sensor is larger than the predetermined second temperature TSU (S2135-N), the supply of power to the second heater unit is cut off and only the first heater unit may be controlled (S2165).

As described above, the heat quantity control method according to the second exemplary embodiment of the present disclosure may use the temperature of the second sensor changed to correspond to the temperature change of the heating roller and may change and control the heat quantity of the heating roller to adapt the temperature change of the pressure roller. In particular, even when the image forming apparatus is turned on as soon as it is temporarily turned off, the temperature value of the second sensor is not affected by the reset of the image forming apparatus. The heat quantity control method as illustrated in FIG. 21 may be performed on the image forming apparatus having the configuration of FIG. 1 and may also be performed on the image forming apparatus having other configurations.

Hereinabove, the exemplary embodiments of the present disclosure are illustrated and described, but the present disclosure is not limited to the above-mentioned specific exemplary embodiment and may be variously modified by those skilled in the art to which the present disclosure pertains without departing from the gist of the present disclosure as defined by the following claims. In addition, these modifications are to fall within the scope of the following claims.

What is claimed is:

1. An image forming apparatus, comprising:

a heating roller to be heated using a first heater unit placed in a central area thereof and second heater units placed on both side areas of the first heater unit;

a pressure roller in pressing contact with the heating roller to form a nip;

a first sensor to detect a temperature of a central area of the heating roller;

a second sensor to detect a temperature of a side area of the heating roller; and a controller to, individually control the first heater unit according to the temperature of the central area of the heating roller detected by the first sensor and the second heater units according to the temperature of the side area of the heating roller detected by the second sensor, when the temperature of the side area of the heating roller detected by the second sensor is lower than a determined first temperature, commonly control the first heater unit and the second heater units according to the temperature of the central area of the heating roller detected by the first sensor, when the temperature of the side area of the heating roller detected by the second sensor is equal to or higher than the determined first temperature.

2. The image forming apparatus as claimed in claim 1, wherein the controller is to individually control the first heater unit according to the temperature of the central area of the roller detected by the first sensor and the second heater units according to the temperature of the side area of the heating roller detected by the second sensor, when the temperature of the side area of the heating roller detected by the second sensor is lower than the determined first temperature, by setting a first heating value based on a temperature difference between the temperature of the central area detected by the first sensor and a central target temperature, to individually control the first heater unit, and setting a second heating value based on a temperature difference between the temperature of the side area of the heating roller detected by the second sensor and a side target temperature to control the second heater units; and the controller is to commonly control the first heater unit and the second heater units according to the temperature of the central area of the heating roller detected by the first sensor, when the temperature of the side area of the heating roller detected by the second sensor is equal to or higher than the determined first temperature, by setting a third heating value based on the temperature difference between the temperature of the central area detected by the first sensor and the central target temperature to commonly control the first heater unit and the second heater units.

3. The image forming apparatus as claimed in claim 2, wherein the controller is to adjust the central target temperature and the side target temperature based on the temperature of the side area of the heating roller detected by the second sensor when the temperature of the side area of the heating roller detected by the second sensor is equal to or higher than the determined first temperature.

4. The image forming apparatus as claimed in claim 1, wherein the controller is to control the first heater unit according to the temperature of the central area detected by the first sensor, and turn off a supply of power to the second heater units when the temperature of the side area of the heating roller detected by the second sensor is equal to or higher than a determined second temperature higher than the first temperature.

5. The image forming apparatus as claimed in claim 4, wherein the controller is to determine that a fuser overheats when the temperature of the side area of the heating roller detected by the second sensor is equal to or higher than a determined third temperature higher than the second temperature, and in response to the controller determining that the fuser overheats, turn off a supply of power to the first heater unit and the second heater units.

6. The image forming apparatus as claimed in claim 1, wherein the first sensor is disposed in a central notification area of the heating roller and the second sensor is disposed in a non-notification area of the heating roller.

7. The image forming apparatus as claimed in claim 6, wherein the first sensor is a non-contacting temperature sensor disposed to be spaced apart from the heating roller and the second sensor is a contacting temperature sensor disposed to contact the heating roller.

8. The image forming apparatus as claimed in claim 1, wherein the controller is to estimate a surface temperature of the pressure roller based on the temperature of the side area of the heating roller detected by the second sensor and to adjust target temperatures of the first heater unit and the second heater units based on the estimated surface temperature.

9. The image forming apparatus as claimed in claim 8, wherein the controller is to use a plurality of correspondences between a plurality of surface temperature ranges and the target temperatures of the first heater unit and the second heater units to control the first heater unit and the second heater units.

10. The image forming apparatus as claimed in claim 1, wherein the controller is to determine whether the second heater units are operated depending on a size of printing paper.

11. A fuser driving control method of an image forming apparatus, comprising:

detecting temperatures of a plurality of areas of a heating roller using a first heater unit placed in a central area thereof, second heater units placed on both side areas of the first heater unit, a first sensor to detect a temperature of a central area of the heating roller and a second sensor to detect a temperature of a side area of the heating roller;

individually controlling the first heater unit according to the temperature of the central area of the heating roller detected by the first sensor and the second heater units according to the temperature of the side area of the heating roller detected by the second sensor, when the temperature of the side area of the heating roller detected by the second sensor is less than a determined first temperature; and commonly controlling the first heater unit and the second heater units according to the temperature of the central area of the heating roller detected by the first sensor, when the temperature of the side area of the heating roller detected by the second sensor is equal to or higher than the determined first temperature.

12. The fuser driving control method as claimed in claim 11, further comprising:

for the individually controlling the first heater unit according to the temperature of the central area of the heating roller detected by the first sensor and the second heater units according to the temperature of the side area of the heating roller detected by the second sensor, when the temperature of the side area of the heating roller detected by the second sensor is less than the determined first temperature, setting a first heating value based on a temperature difference between a temperature of the central area detected by the first sensor and a central target temperature, to individually control the first heater unit, and setting a second heating value based on a temperature difference between a temperature of the side area of the heating roller detected by the second sensor and a side target temperature, to individually control the second heater units; and for the commonly controlling the first heater unit and the second heater units according to the temperature of the central area of the heating roller detected by the first sensor, when the temperature of the side area of the heating roller detected by the second sensor is equal to or higher than the determined first temperature, setting a third heating value based on the temperature difference between the temperature of the central area detected by the first sensor and the central target temperature to commonly control the first heater unit and the second heater units.

13. The fuser driving control method as claimed in claim 12, further comprising:

for the commonly controlling the first heater unit and the second heater units according to the temperature of the central area of the heating roller detected by the first sensor, when the temperature of the side area of the heating roller detected by the second sensor is equal to or higher than the determined first temperature, adjusting the central target temperature and the side target temperature based on the temperature of the side area of the heating roller detected by the second sensor.

14. The fuser driving control method as claimed in claim 11, further comprising: controlling the first heater unit according to the temperature of the central area detected by the first sensor and controlling a supply of power to the second heater units to be turned off, when the temperature of the side area of the heating roller detected by the second sensor is equal to or higher than a determined second temperature higher than the first temperature.

15. The fuser driving control method as claimed in claim 14, further comprising:

determining that a fuser overheats when the temperature of the side area of the heating roller detected by the second sensor is equal to or higher than a determined third temperature higher than the second temperature, and in response to the determining that the fuser overheats, turning off a supply of power to the first heater unit and the second heater units.

* * * * *